US007184520B1

(12) United States Patent
Sano

(10) Patent No.: US 7,184,520 B1
(45) Date of Patent: Feb. 27, 2007

(54) COMPONENT MOUNTING SYSTEM WITH STRESS COMPENSATION

(75) Inventor: Richard R. Sano, Salt Lake City, UT (US)

(73) Assignee: Varian Medical Systems Technologies, Inc., Palo Alto, CA (US)

( * ) Notice: Subject to any disclaimer, the term of this patent is extended or adjusted under 35 U.S.C. 154(b) by 29 days.

(21) Appl. No.: 10/353,433

(22) Filed: Jan. 29, 2003

(51) Int. Cl.
*H01J 35/10* (2006.01)

(52) U.S. Cl. ..... 378/125; 378/121; 378/132; 378/144

(58) Field of Classification Search ..... 378/121, 378/125, 127, 128, 132, 144; 411/427, 432
See application file for complete search history.

(56) References Cited

U.S. PATENT DOCUMENTS 2,286,895 A * 6/1942 Carlson ..... 411/291
2,546,332 A * 3/1951 Costello ..... 411/9
3,753,021 A * 8/1973 Braun ..... 378/127
3,795,832 A * 3/1974 Holland ..... 378/127
3,821,581 A * 6/1974 Holland et al. ..... 378/127
3,900,751 A * 8/1975 Holland et al. ..... 378/125
4,276,493 A * 6/1981 Srinivasa et al. ..... 378/144
4,481,655 A * 11/1984 Annis et al. ..... 378/125
4,670,895 A * 6/1987 Penato et al. ..... 378/125
4,736,400 A * 4/1988 Koller et al. ..... 378/125
4,813,835 A * 3/1989 Toth ..... 411/429
5,090,854 A * 2/1992 Hafeli et al. ..... 411/186
5,533,863 A * 7/1996 Tornquist et al. ..... 415/229
5,810,533 A * 9/1998 Nakamura ..... 411/432
5,871,322 A * 2/1999 Nakamura ..... 411/432
6,050,741 A * 4/2000 Aultman et al. ..... 403/374.1
6,088,426 A * 7/2000 Miller ..... 378/144
6,089,807 A * 7/2000 Larsson ..... 411/433
6,261,041 B1 * 7/2001 Nakamura ..... 411/432
6,819,742 B1 * 11/2004 Miller ..... 378/144

OTHER PUBLICATIONS

Cullity and Stock. Elements of X-Ray Diffraction, third edition (Upper Saddle River, NJ: Prentice Hall, 2001), Chapter 15.*

* cited by examiner

*Primary Examiner*—Allen C. Ho
(74) *Attorney, Agent, or Firm*—Workman Nydegger

(57) ABSTRACT

A component mounting system that includes a rotor stem, nut, and mechanical interface. The mechanical interface defines a shaped surface and is integral with the component. An axial opening in the component permits the component to be mounted on the rotor stem. The nut defines a second shaped surface and one or more annular slots. As the nut is advanced along a threaded portion of the rotor stem, the shaped surfaces contact each other and serve to automatically center the component on the rotor stem. The annular slot defined by the nut permits the nut to elastically deform under the influence of various operating conditions, and thereby alleviate forces that are exerted on the elements of the component mounting system.

10 Claims, 5 Drawing Sheets

COMPONENT MOUNTING SYSTEM WITH STRESS COMPENSATION

CROSS-REFERENCE TO RELATED APPLICATION

Not applicable.

BACKGROUND OF THE INVENTION

1. The Field of the Invention

The present invention relates generally to mounting systems for securing one or more components mounted to a rotatable shaft. More particularly, embodiments of the present invention relate to target anode mounting systems and devices that include various features which serve to reliably and effectively establish and maintain the position of the target anode in a variety of operating conditions, and that serve to redistribute at least some of the stress imposed on the target anode and other components as a result of operating conditions.

2. Related Technology

X-ray producing devices are valuable tools that are used in a wide variety of industrial, medical, and other applications. For example, such equipment is commonly used in areas such as diagnostic and therapeutic radiology, semiconductor manufacture and fabrication, and materials analysis and testing. While they are used in various different applications, the different x-ray devices share the same underlying operational principles. In general, x-rays, or x-ray radiation, are produced when electrons are produced, accelerated, and then impinged upon a material of a particular composition.

Typically, these processes are carried out within a vacuum enclosure. Disposed within the vacuum enclosure is an electron generator, or cathode, and a target anode, which is spaced apart from the cathode. In operation, electrical power is applied to a filament portion of the cathode, which causes a stream of electrons to be emitted by the process of thermionic emission. A high voltage potential applied across the anode and the cathode causes the electrons emitted from the cathode to rapidly accelerate towards a target surface, or focal track, positioned on the target anode.

The accelerating electrons in the stream strike the target surface, typically a refractory metal having a high atomic number, at a high velocity and a portion of the kinetic energy of the striking electron stream is converted to electromagnetic waves of very high frequency, or x-rays. The resulting x-rays emanate from the target surface, and are then collimated through a window formed in the x-ray tube for penetration into an object, such as the body of a patient. As is well known, the x-rays can be used for therapeutic treatment, or for x-ray medical diagnostic examination or material analysis procedures.

In addition to stimulating the production of x-rays, the kinetic energy of the striking electron stream also causes a significant amount of heat to be produced in the target anode. As a result, the target anode typically experiences extremely high operating temperatures, as high as 2400° C. during normal operations. However, the anode is not the only element of the x-ray tube subjected to such operating temperatures.

In particular, components such as the rotor stem, and the nut which secures the anode on the rotor stem, are also exposed to these high temperatures as a result of their proximity to, and substantial contact with, the anode. Additional heat is also generated by those electrons that strike the target surface but do not generate x-rays, and instead simply rebound from the surface and then impact another "non-target" surfaces within the x-ray tube evacuated enclosure. These are often referred to as "secondary" electrons. These secondary electrons retain a large percentage of their kinetic energy after rebounding, and when they impact these other non-target surfaces, a significant amount of heat is generated.

The heat produced by secondary electrons, in conjunction with the high temperatures present at the anode, often reaches levels high enough to damage portions of the x-ray tube structure. Thus, the joints and connection points between x-ray tube structures may be weakened when repeatedly subjected to such thermal stresses.

The destructive structural effects often observed in x-ray devices are not solely a function of high temperatures however, but may also be exacerbated by the relative rate of change of the temperature, or thermal stress cycling, that occurs over time. For example, the temperature in the anode region may, in some cases, increase from about 20° C. to about 1250° C. in a matter of minutes. The relatively rapid rate at which such temperature changes take place, coupled with the magnitude of the temperature change, imposes significant thermal stress and strain in the x-ray device components, and can ultimately lead to the permanent deformation and/or failure of such components.

In addition to being exposed to extreme thermal stresses, many components of the x-ray device, such as the anode and the target surface of the anode, as well as the mounting system and devices used to secure the anode to the rotor stem, are also subjected to high levels of mechanical stress induced by high speed rotation of the anode and rotor stem. For example, in many rotating anode type x-ray devices, the anode, the rotor stem and the nut used to attach the anode to the rotor stem, are subjected to high stress "boost and brake" cycles. In a typical boost and brake cycle, the anode may be accelerated from zero to ten thousand (10,000) revolutions per minute (RPM) in less than ten seconds. This high rate of acceleration imposes significant mechanical stresses on the anode, the rotor stem and the nut. Thus, the components which are used to secure the anode in position are exposed not only to extreme thermal stresses, but are simultaneously exposed to significant stresses imposed by the mechanical operations of the x-ray device.

The rotor stem, the nut, and the target surface of the anode are particularly vulnerable to such thermal and mechanical stresses, at least in part as a consequence of their chemical compositions and physical configurations. In particular, while the aforementioned components are all typically comprised substantially of low thermal expansion metals, it is often the case that these components heat up at different rates within the typical x-ray device operating temperature range of about 25° C. to about 1300° C. That is, while such components may generally expand to about the same extent, the speed with which they achieve such expansion typically varies from one component to another.

One consequence of the mismatch in thermal expansion rates is that one or more of the components may become permanently deformed over a period of time. As a result of such deformation, the components no longer fit tightly together and may vibrate during operation of the x-ray device. Such vibration is problematic at least because it increases the noise level associated with operation of the x-ray device, and because it contributes to motion of the focal spot on the target surface of the anode. Generally, motion of the focal spot is undesirable because it tends to compromise the quality of the images that can be obtained with the x-ray device.

The vibration problems resulting from the permanent deformation of one or more of the components used to secure the anode in position are further exacerbated by characteristics commonly encountered in known designs. For example, in many rotating component applications and environments, such as rotating anode type x-ray devices, a gap is defined between the outside diameter of the rotor stem and the opening in the anode through which the rotor stem passes.

Generally, the purpose of such a gap is to permit manipulation of anode orientation prior to operation of the x-ray device. In particular, the gap allows the assembler to attempt to minimize anode run-out with respect to the rotor stem by shifting the position of the anode slightly. However, while such a gap is useful in that it permits initial positioning of the anode with respect to the rotor stem, the gap also allows undesirable lateral movement, or radial runout, of the anode when the anode is subjected to mechanical and thermal stresses. Failure to compensate for such radial runout by limiting or preventing the movement of the target anode often results in problems with the operation of the device. For example, such radial runout frequently causes vibration and noise during operation of the x-ray device.

Another problem stemming from the extreme operating temperatures to which the target surface of the anode, the nut, and the rotor stem are exposed concerns the forces, including axial forces, that result from such extreme temperatures. As suggested by their name, "axial" forces generally refer to those forces exerted in a direction substantially parallel to the longitudinal axis of the rotor stem.

It was noted above that heating of the rotor stem, target surface, and nut during operation of the x-ray device causes those components to expand. Much of this thermal expansion occurs in a generally axial direction. However, because typical mounting systems are unable to accommodate or otherwise compensate for this thermal expansion, the thermal expansion of the individual components collectively acts to compress the rotor stem, target surface and nut, and thereby impose large compressive forces on those components. In some cases, the forces thus exerted are of a magnitude sufficient to permanently deform one or more of the components. As noted above, such deformation may induce, among other things, vibration and undesirable focal spot motion.

In view of the foregoing problems, and others, a need exists for a component mounting system that facilitates reliable and maintainable positioning of the mounted component on a rotary shaft, and that is able to compensate for, or otherwise mitigate, stresses imposed on the mounting system and other components as a result of operational conditions.

BRIEF SUMMARY OF VARIOUS FEATURES OF THE INVENTION

The present invention has been developed in response to the current state of the art, and in particular, in response to these and other problems and needs that have not been fully or adequately resolved by currently available component mounting systems.

Briefly summarized, embodiments of the present invention provide a mounting system for a component that controls axial movement of the component, such as by moving, or resisting the movement of, the component relative to a shaft to which the component is mounted. The mounting system also includes features directed to providing compensation for forces such as may be imposed on the mounting system or other components during operation of the device.

Embodiments of the present invention are particularly well suited for use in rotating anode type x-ray tubes. However, embodiments of the present invention are suitable for use in any application or environment where it is desired to control axial movement of a shaft mounted component, while at the same time mitigating the effects of thermally induced, and other, forces exerted on such component.

In one embodiment of the invention, a mounting system is provided that includes a rotor stem having a threaded portion and including a support member. The rotor stem and support member are configured and arranged so that at least a portion of the rotor stem resides within an axial opening of the component which is to be mounted when the component is seated on the support member. Preferably, the support member is integral with the rotor stem. The mounting system further includes a mechanical interface which is connected to the component and which defines a shaped surface. Preferably, the mechanical interface is integral with the component which is to be mounted.

Finally, the mounting system includes a nut configured to threadingly engage the threaded portion of the rotor stem. The nut includes a second shaped surface that is configured and arranged to contact at least a portion of the first shaped surface defined by the mechanical interface when the component is retained against the support member by the nut. The nut further includes at least one annular slot preferably having a substantially rectangular cross section.

In operation, the component is mounted to the rotor stem by inserting the rotor stem through the axial opening defined by the component. The component is arranged so that the shaped surface defined by the mechanical interface is disposed opposite the support member of the rotor stem. The nut is oriented so that the second shaped surface defined by the nut is disposed towards the first shaped surface defined by the mechanical interface and the nut is then engaged with the threaded portion of the rotor stem.

As the nut advances down the rotor stem and the shaped surfaced of the nut contacts the shaped surface defined by the mechanical interface, the shaped surface of the nut exerts a force that includes both radial and axial components, or forces, which act with respect to the corresponding shaped surface of the mechanical interface. Generally, the axial force serves to maintain the component in a desired location along the rotor stem.

Further, because the radial force is exerted equally around the circumference of the shaped surface of the mechanical interface, the radial force is effective in centering the mechanical interface, and thus the component to which the mechanical interface is attached, with respect to the rotor stem. In this way, the respective shaped surfaces of the mechanical interface and the nut cooperate with each other to insure that, regardless of the initial orientation of the component on the rotor stem, the component will be centered on the rotor stem upon completion of the tightening of the nut.

Further, the aforementioned arrangement is also effective in compensating for any gap that may exist between the outside diameter of the rotor stem and the diameter of the axial opening defined by the component to be mounted. This is a particularly useful feature where it is desirable to minimize imbalance of the mounted component by insuring that the component is centered with respect to the rotor stem.

In the context of a rotating anode x-ray tube, for example, this feature serves to substantially eliminate unbalanced rotary motion of the rotating anode and thereby substantially forecloses motion of the focal spot that typically results from an improperly mounted anode. By reducing or eliminating motion of the focal spot, embodiments of the present invention are effective in contributing to an over all improvement in the quality of images obtained with the x-ray device.

Yet other advantages of embodiments of the invention relate to the ability of the nut to effectively compensate for, or otherwise mitigate, stresses such as may occur during operations where large thermal gradients are experienced. For example, if the mounting system is exposed to high operating temperatures, the components and/or the mechanical interface will naturally expand as they are heated. As these components expand, they exert various forces on each other and upon the nut. The annular slot defined by the nut permits a portion of the nut to elastically deform, or flex, in response to the imposition of such forces. This flexing ability of the nut allows the nut to instantaneously and continuously compensate for stresses imposed upon on elements of the mounting system and/or the mounted component as a result of high operating temperatures.

Because the nut is able to compensate for, or otherwise mitigate, such forces in this way, the nut is effective in preventing the permanent deformation of the mechanical interface or the mounted component or the components of the mounting system, or other components with which the mounting system may be employed. Further, as the various components of the mounting system return to room temperature, the nut gradually assumes its unheated configuration. Thus, embodiments of the mounting system are also effective in maintaining a relatively constant axial force on the component over a wide range of operating temperatures.

These and other features and advantages of the present invention will become more fully apparent from the following description and appended claims.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF VARIOUS EMBODIMENTS OF THE INVENTION

Reference will now be made to figures wherein like structures will be provided with like reference designations. It is to be understood that the drawings are diagrammatic and schematic representations of various embodiments of the invention, and are not to be construed as limiting the present invention, nor are the drawings necessarily drawn to scale.

Figure 1:
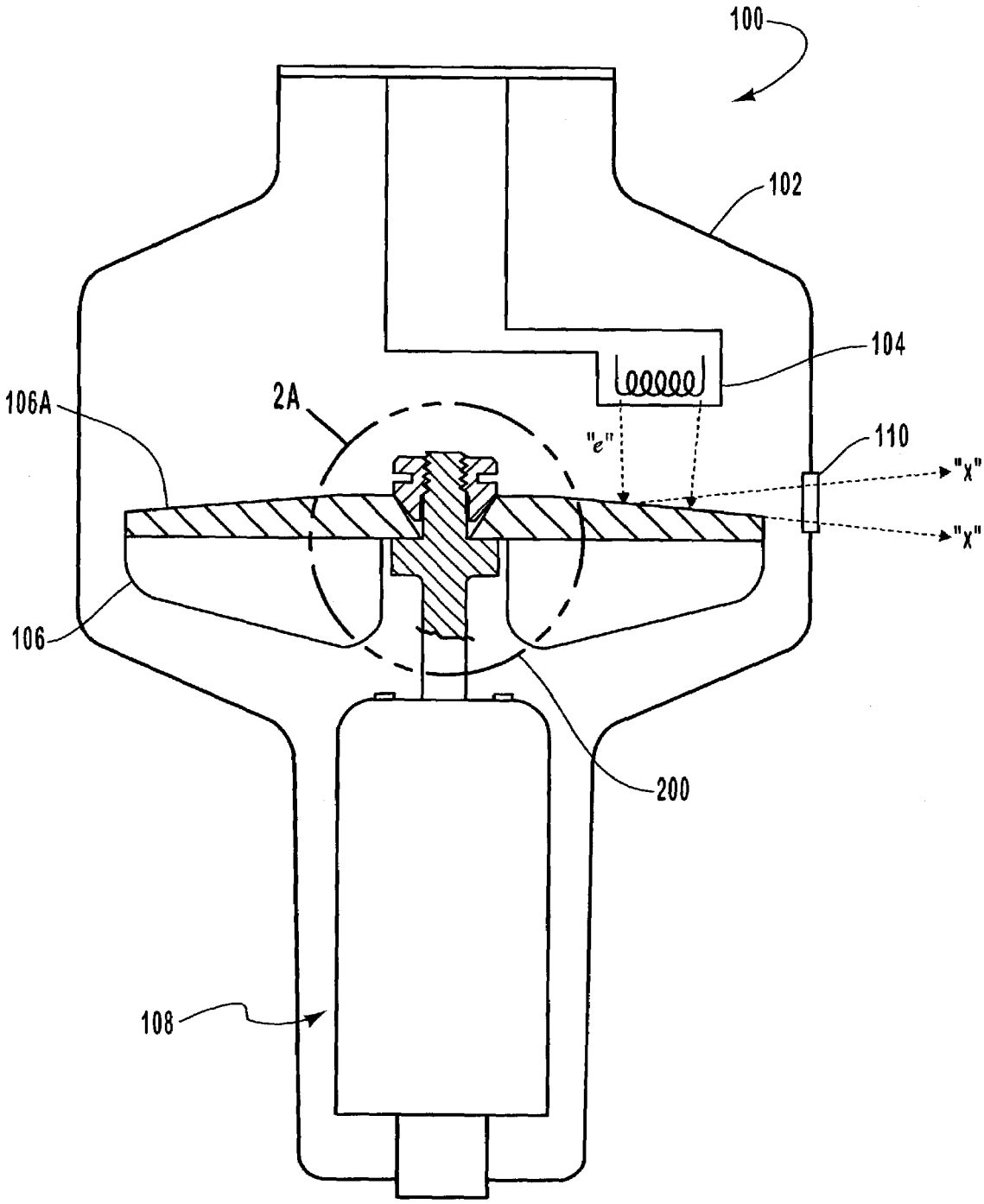
FIG. 1 illustrates an exemplary operating environment for embodiments of the present invention, and specifically illustrates a rotating anode type x-ray device.

Reference is first made to FIG. 1, wherein an x-ray tube is indicated generally at 100. As indicated in the illustrated embodiment, x-ray tube 100 includes a vacuum enclosure 102, inside which is disposed an electron source 104, preferably comprising a cathode or the like, and an anode 106 arranged in a spaced-apart configuration with respect to electron source 104 and rotatably supported by bearing assembly 108. Further, anode 106 is securely retained in a desired position and orientation by way of bearing assembly 108 and mounting system 200. Finally, anode 106 includes a target surface 106A, preferably comprising a refractory metal such as tungsten or the like, arranged so as to receive electrons emitted by electron source 104. The x-rays produced by x-ray tube 100 pass out of vacuum enclosure 102 by way of a window 110, preferably comprising beryllium or the like.

With continuing attention to FIG. 1, details are provided regarding various operational features of the illustrated embodiment of x-ray tube 100. In operation, a stator (not shown) disposed about bearing assembly 108 causes anode 106 to rotate at high speed. Power applied to electron source 104 causes electrons, denoted at "e" in FIG. 1, to be emitted by thermionic emission and a high voltage potential applied across electron source 104 and anode 106 causes the emitted electrons "e" to rapidly accelerate from electron source 104 toward target surface 106A of anode 106. Upon reaching anode 106, electrons "e" strike target surface 106A causing x-rays, denoted at "x" in FIG. 1 to be produced. The x-rays, denoted at "x," are then collimated and passed through window 110 and into a subject, for example, the body of a patient.

Figure 2A:
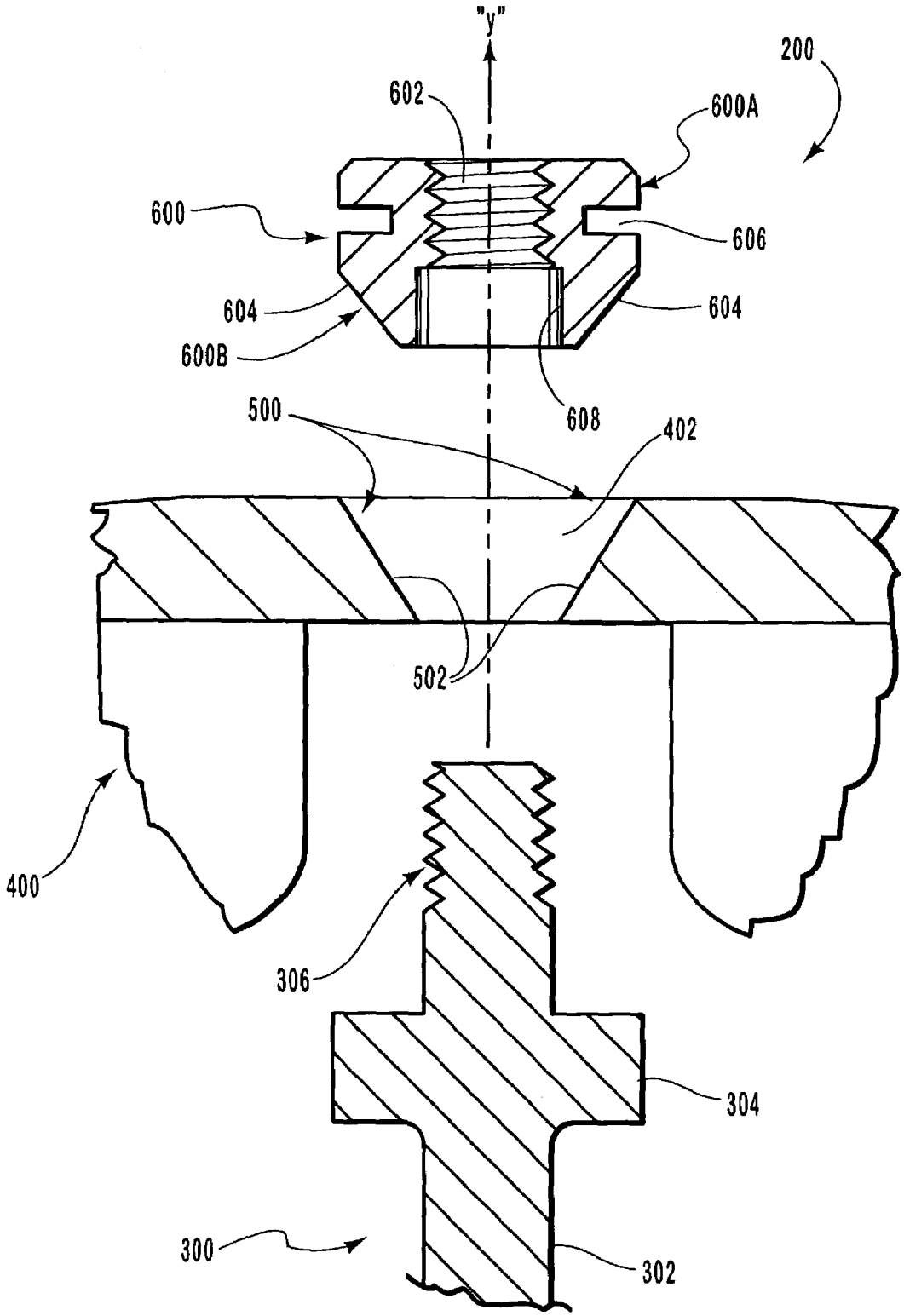
FIG. 2A is an exploded view indicating various components of an embodiment of a mounting system.

Directing attention now to FIG. 2A, various details are provided regarding an embodiment of mounting system 200 suitable for use in mounting one or more components on a shaft, rotor stem, or other rotating structure. In the illustrated embodiment, mounting system 200 includes a rotor stem 300, upon which a component 400 may be mounted, a mechanical interface 500, and a nut 600. In at least one embodiment of the invention, component 400 comprises an anode such as may be employed in a rotating anode type x-ray device. Generally, component 400 is mounted to rotor stem 300 and oriented such that mechanical interface 500 faces nut 600. Component 400 can then be positioned, and securely retained in place, by advancing nut 600 along rotor stem 300 until nut 600 exerts a desired force on mechanical interface 500.

In the illustrated embodiment of the invention, mechanical interface 500 is integral with component 400. In yet other embodiments, mechanical interface 500 is separate from, but connected to, component 400. Such exemplary arrangements and configurations should not be construed as limiting however. In general, any structural configurations of mechanical interface 500 and component 400, as well as any arrangements of mechanical interface 500 and component 400, that implement the functionality disclosed herein may be employed.

With continuing attention to FIG. 2A, further discussion is provided regarding selected details of the various aspects of mounting system 200. As noted above, mounting system 200 includes, among other things, rotor stem 300 upon which component 400 is mounted. In general, rotor stem 300 is composed of stainless steel or other metals or metal alloys having properties similar to those of stainless steel that are appropriate for use in high energy and high heat environments such as are commonly associated with rotating anode type x-ray devices. However, various other materials may alternatively be employed as required to suit a particular application or operating environment.

Further, rotor stem 300 includes a body 302, an integral support member 304, and a threaded portion 306. Support member 304 may alternatively comprise a separate component joined to body 302 by welding, brazing, or other suitable processes. In the illustrated embodiment, support member 304 takes the form of an annular flange that extends substantially completely around body 302 of rotor stem 300.

In an alternative embodiment, support member 304 comprises multiple discrete portions integral with, or otherwise joined to, body 302, which cooperate with each other to collectively define a structure having substantially the same functionality as the illustrated embodiment of support member 304. By way of example, support member 304 may be embodied as three discrete structures equally spaced about the circumference of body 302 of rotor stem 300. In general however, any structure, or combination of structures, may be employed which provides the functionality of support member 304, as disclosed herein. As discussed in further detail below, one function of support member 304 is to provide support for component 400.

In particular, component 400 defines an axial opening 402 within which threaded portion 306 of rotor stem 300 is received, and component 400 is arranged on rotor stem 300 so that mechanical interface 500 faces nut 600. In one embodiment of the invention, component 400 comprises an anode such as are typically employed in the context of a rotating anode type x-ray tube. However, component 400 may alternatively comprise any other component which is desired to be mounted to a rotatable shaft and/or which is desired to be centered with respect to a shaft to which component 400 is mounted. Accordingly, the scope of the present invention should not be construed to be limited in any way to x-ray tube applications.

In the embodiment illustrated in FIG. 2A, mechanical interface 500 of mounting system 200 is integral with component 400. Generally, mechanical interface 500 defines an annular shaped surface 502 that is oriented toward a complementary shaped surface, discussed below, of nut 600. In the illustrated embodiment, shaped surface 502 and shaped surface 604, discussed below, each are beveled at a predetermined angle. Any angles effective in implementing the functionality disclosed herein may be employed. Further, embodiments of the invention are not limited to the beveled forms of shaped surface 502 and shaped surface 604, rather, any geometry suitable to implement the functionality disclosed herein may be employed. Thus, the respective geometries of shaped surface 502 and shaped surface 604 illustrated in FIG. 2A, among others, are exemplary only and should not be construed as limiting the scope of the invention.

In embodiments where mechanical interface 500 is integral with component 400, mechanical interface 500 simply comprises the same material as component 400. Alternatively, where mechanical interface 500 is a discrete component separate from, but attached to, component 400, mechanical interface 500 may comprise any material, or materials, compatible with component 400 and suitable for use in the intended operating environment. Materials appropriate for use in an x-ray tube environment, for example, include stainless steels and other similar alloys.

Finally, nut 600 of mounting system 200 cooperates with mechanical interface 500 to position and secure component 400 on rotor stem 300. In general, nut 600 defines an axial opening 602 internally threaded to engage threaded portion 306. As discussed in further detail below, nut 600 additionally defines a shaped surface 604 which is configured and arranged to engage shaped surface 502 of mechanical interface 500 when nut 600 is advanced sufficiently far along threaded portion 306 of rotor stem 300. While shaped surface 604 is presented as substantially continuous in FIG. 2A, among others, shaped surface 604 need not be a continuous annular surface, and may alternatively comprise a plurality of discrete surfaces disposed about axis "y" in a desired arrangement.

In addition to shaped surface 604, nut 600 includes a base portion 600A and a contact portion 600B that cooperate to define at least one slot 606. In the illustrated embodiment, base portion 600A and contact portion 600B are integral with each other, and slot 606 comprises a substantially rectangular cross section and is substantially annular with respect to nut 600. However, various other cross sectional shapes of slot 606 may be employed as well. Likewise, variables including, but not limited to, the size, shape, number, and arrangement of slot(s) 606 may be varied as required to suit a particular application or operating environment.

Various means may be profitably employed to perform the functions, enumerated herein, of slot 606. Accordingly, the structural configuration embodied by the slot 606 defined by nut 600 is but one example of a means for stress compensation. By way of example, alternative structural configurations may provide for two or more slots 606, slot 606 of alternating depths, or other arrangements. It should thus be understood that such structural configurations are presented herein solely by way of example and should not be construed as limiting the scope of the present invention in any way.

Figure 2B:
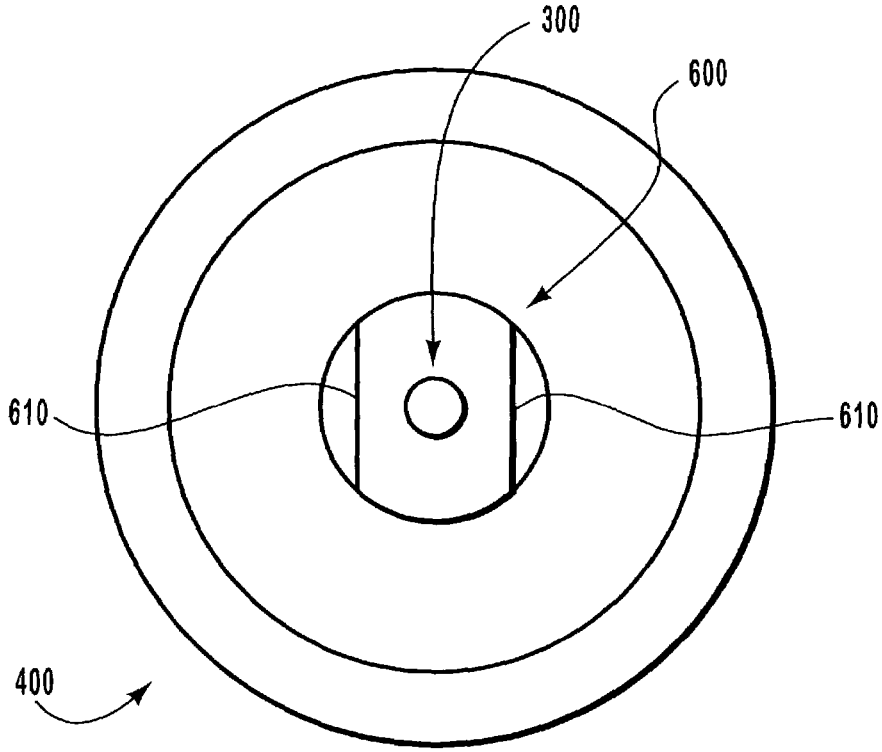
FIG. 2B is a top view of an embodiment of the mounting system illustrated in FIG. 2A.

With reference now to FIG. 2B, nut 600 further includes a set of wrench flats 610 which generally provide a gripping surface for a wrench or similar device which may be used to tighten nut 600 on threaded portion 306 of rotor stem 300. While the illustrated embodiment comprises two wrench flats 610, various other configurations may likewise be employed. For example, a hexagonal arrangement may be employed, which comprises six wrench flats 610. In general however, any structure which permits nut 600 be readily advanced or retracted along threaded portion 306 of rotor stem 300 may be employed.

Figure 3:
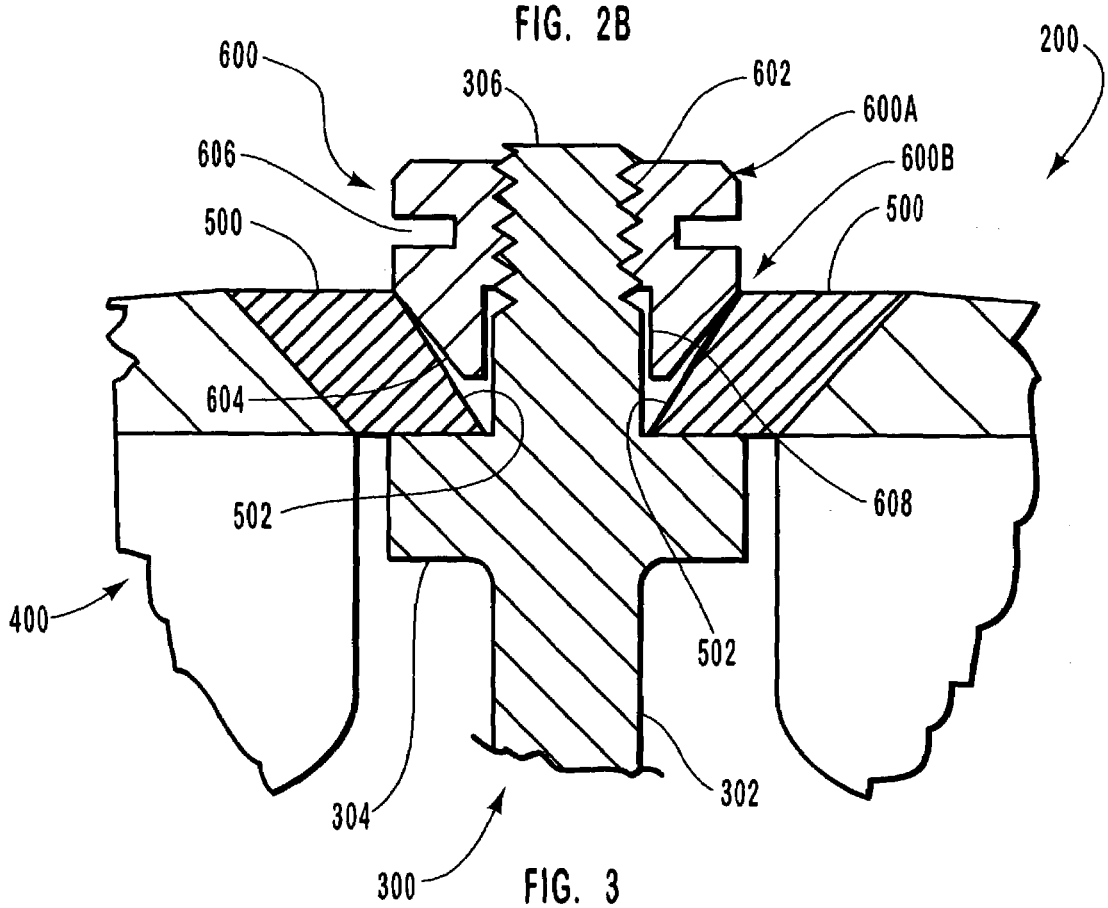
FIG. 3 is a cross-section view illustrating an alternative embodiment of a mounting system wherein the mechanical interface comprises a component separate from, but connected to, the component to be mounted.

Directing attention briefly now to FIG. 3, an alternative embodiment of mechanical interface 500 is illustrated. While the embodiment of mechanical interface 500 illustrated in FIG. 2A is integral with component 400, mechanical interface 500 may alternatively comprise a structure separate from component 400. In particular, in at least one alternative embodiment, mechanical interface 500 comprises a separate structure as indicated in FIG. 3. In such alternative embodiment, mechanical interface 500 may be glued, bonded, or otherwise securely joined to component 400. Generally however, any other structure, or combination of structures that provide the functionality of mechanical interface 500 may likewise be employed.

Figures 4A, 4B:
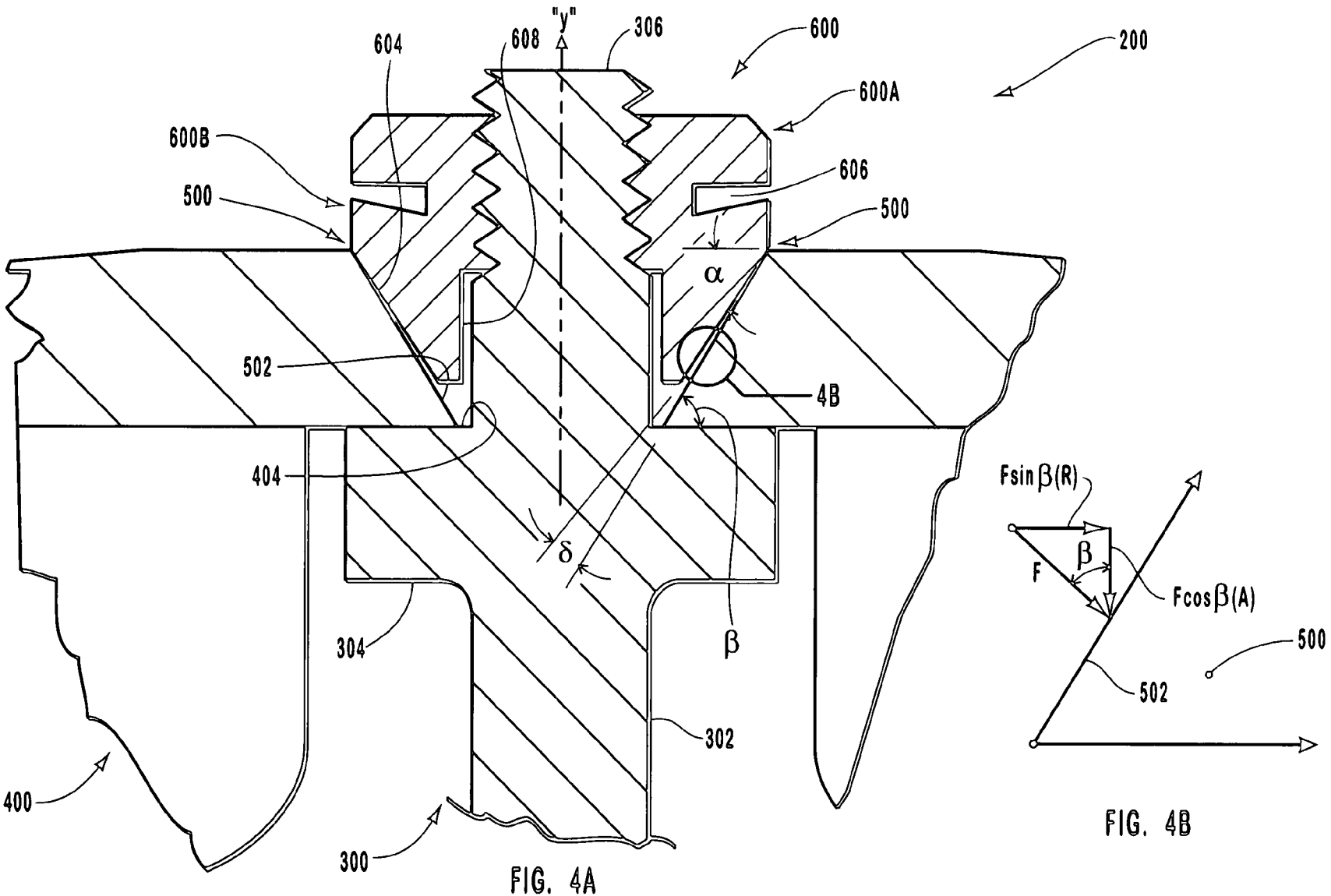
FIG. 4A is a cross-section view showing the relationships of various components of an embodiment of a mounting system, employed in conjunction with a mounted component, when the mounting system is assembled for operation.
FIG. 4B is a diagram depicting various characteristics of the forces typically exerted on the mounted component.

With attention now to FIGS. 4A and 4B, further details are provided regarding selected features of mechanical interface 500 and nut 600 of mounting system 200. As indicated in FIG. 4, axial opening 602 of nut 600 is threaded so as to be capable of engagement with threaded portion 306 of rotor stem 300. However, nut 600 further includes a counterbore 608, which is unthreaded and has a diameter larger than the outside diameter of threaded portion 306 of rotor stem 300. Thus, the portion of nut 600 in the area of counterbore 608 does not contact threaded portion 306 of rotor stem 300. One feature of counterbore 608 is that it permits a slight compression of contact portion 600B of nut 600 as nut 600 is advanced toward mechanical interface 500. Further, counterbore 608 facilitates the elastic deformation of nut 600, discussed below, as nut 600 reacts to forces imposed on mounting system 200.

With continued attention now to shaped surface 604, a nut angle $\alpha$ is defined. In one embodiment, nut angle $\alpha$ is about 45 degrees and mechanical interface angle $\beta$ is about 46 degrees, so that an offset angle $\delta$ defined between mechanical interface angle $\beta$ and nut angle $\alpha$ is about 1 degree. However, offset angle $\delta$, mechanical interface angle $\beta$, and/or nut angle $\alpha$ may be varied either alone or in combination as required to suit a particular application or operating environment. In one embodiment of the invention, offset angle $\delta$ is defined with respect to room temperature (65 degrees Fahrenheit), and the magnitude of offset angle $\delta$ may accordingly vary during operation of the device with which mounting system 200 is employed.

Generally, as nut 600 is advanced along threaded portion 306 of rotor stem 300, shaped surface 604 (FIG. 4A) of nut 600 comes into contact with shaped surface 502 of mechanical interface 500. As nut 600 is tightened further, shaped surface 604 of nut 600 exerts a force, denoted at "F" in FIG. 4B, on shaped surface 502 of mechanical interface 500. The respective geometries of shaped surface 604 and shaped surface 502 permit this force "F" to be exerted and transmitted in a manner that has various useful implications.

Specifically, such force "F" may be represented as acting along a line generally perpendicular to shaped surface 502 and comprising two components. One component is an axial force, denoted at "A," which can be approximated as (F×cosine $\beta$) and which acts on shaped surface 502 in a direction generally parallel to axis "y." The other component of force "F" is a radial force, denoted at "R," which can be approximated as (F×sine $\beta$) and which acts on shaped surface 502 in a direction generally perpendicular to axis "y."

If component 400 is not centered relative to rotor stem 300 prior to the tightening of nut 600, radial force "R" will be exerted by shaped surface 604 of nut 600 on only a portion of shaped surface 502 and will thus cause component 400 to shift laterally, with respect to an axis "y" defined by rotor stem 300, in the direction of the applied force. However, as component 400 shifts laterally, that portion of shaped surface 502 not initially subjected to radial force "R" moves into contact with nut 600 and is also subjected to radial force "R." As a result of this subsequent application of radial force "R," the lateral movement of component 400 may stop and/or change direction.

Such lateral movements of component 400 continue until the tightening of nut 600 progresses to the point that a state of static equilibrium is reached wherein radial force "R" is being exerted on all portions of shaped surface 502. That is, at static equilibrium, radial force "R" is exerted uniformly about axis "y." At such time as static equilibrium is achieved, lateral movement of component 400 will cease. Because a lateral shift of component 400 can only occur when component 400 is off-center with respect to axis "y," the cessation of lateral motion of component 400 indicates that component 400 is in a centered position with respect to axis "y." Note that some alternative embodiments are configured and arranged so that the desired position achieved by component 400 is an off-center position with respect to rotor stem 300, instead of the centered position just described.

As noted above, force "F" also comprises an axial force "A." Generally, axial force "A" serves to, among other things, establish and maintain component 400 at a desired location along shaft 300. Thus, in the case of the illustrated embodiment, nut 600, shaped surface 502 and shaped surface 604 cooperate to simultaneously exert radial and axial forces on component 400.

Finally, note that embodiments of the present invention include various additional features directed toward facilitating the adjustment of the lateral position of component 400. For example, component 400 cooperates with rotor stem 300 to define an adjustment gap 404 which permits lateral motion of component 400 as nut 600 is tightened. As another example, in at least some embodiments of the invention, shaped surface 502 and/or shaped surface 604 are characterized by a relatively low coefficient of friction so as to enable the position of component 400 to be readily adjusted as nut 600 advances along rotor stem 300. Such low friction coefficients may be achieved in various ways, such as by polishing shaped surface 502 and/or shaped surface 604, or through the application of appropriate coatings or layers to shaped surface 502 and/or shaped surface 604. Support member 304 and/or anode 106 include similar low friction characteristics in at least some embodiments of the invention.

Various means may be profitably employed to perform the collective functions, disclosed herein, of nut 600, shaped surface 502 and shaped surface 604. Accordingly, the structural configuration embodied by nut 600, shaped surface 502 and shaped surface 604 is but one example of a means for component positioning. In one exemplary alternative structural configuration, shaped surface 604 is defined by support member 304 instead of being defined by nut 600. Generally however, any structure or structural combination suitable to implement the functionality disclosed herein may be employed. It should thus be understood that such structural configurations are presented herein solely by way of example and should not be construed as limiting the scope of the present invention in any way.

As the foregoing discussion indicates, embodiments of the present invention include a variety of useful features and advantages. For example, one advantage of embodiments of the present invention is that an assembler can mount component 400 to rotor stem 300 and can quickly and easily center component 400 simply by tightening nut 600. No time-consuming adjustments by the assembler are required because shaped surfaces 502 and 604 cooperate with each other to automatically adjust the lateral position of component 400 as nut 600 is tightened.

As another example, embodiments of the present invention are also helpful in preventing "wobble," and other undesirable phenomena often associated with uncentered rotating components, by facilitating the centering of a component on a rotatable shaft. Further, by reducing or eliminating phenomena such as wobbling of the component, embodiments of the invention are thereby effective in reducing vibration and mechanical stresses and strains that typically accompany rotation of uncentered components. These features of embodiments of the present invention are particularly useful in environments, such as rotating anode x-ray tubes, where the component may be rotated at speeds as high as 10,000 rpm or more.

Finally, by substantially eliminating or foreclosing radial runout, or lateral motion of component 400, during operation, embodiments of the present invention provide a stable mechanical joint which ensures optimum positioning and balancing of component 400 over a wide range of operating conditions. This feature is especially useful in the context of rotating anode type x-ray tubes where proper orientation of the rotating anode is an important factor in focal spot stabilization, and thus the quality of the image obtained with the x-ray device.

Figure 5A:
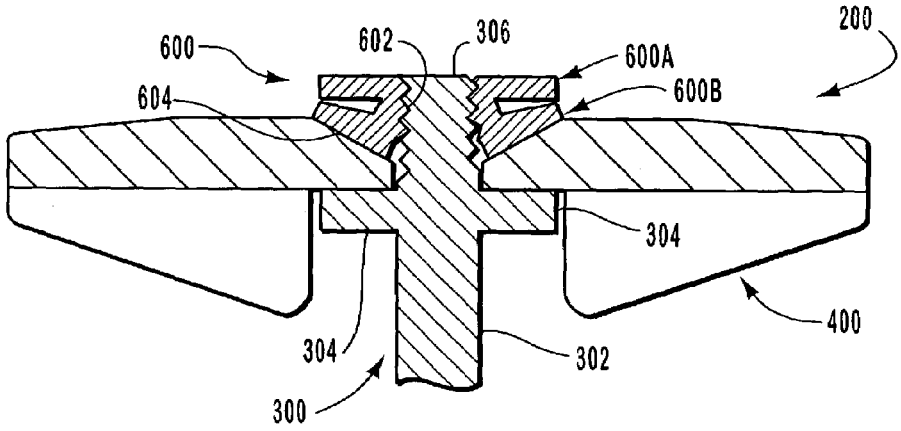
FIG. 5A is a cross-section view illustrating an exemplary response of the nut of the mounting system to axial stress.
Figure 5B:
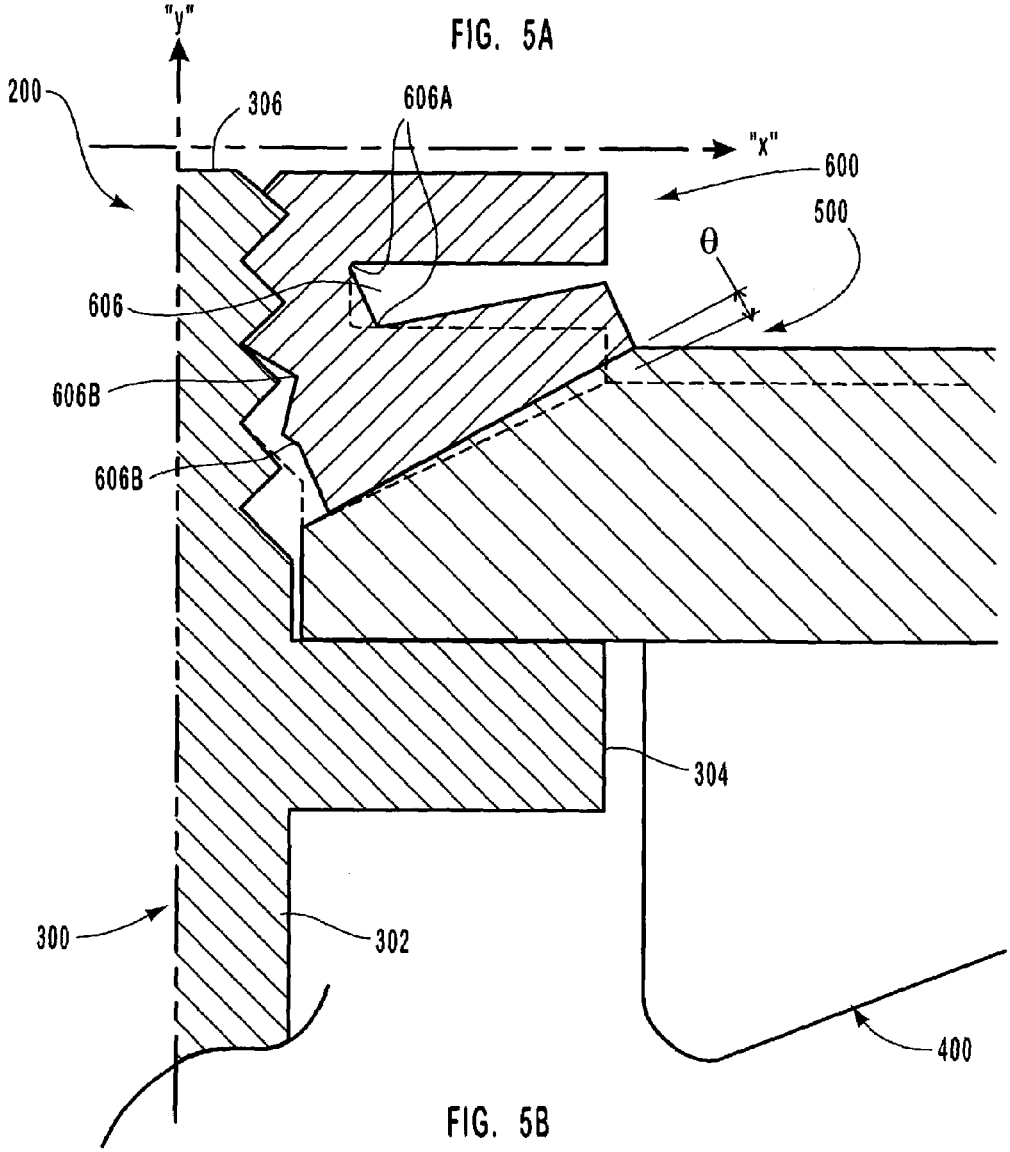
FIG. 5B is a cross-section detail view of the nut illustrated in FIG. 5A, indicating more specifically an exemplary reaction of the nut to axial stress.

Directing attention now to FIGS. 5A and 5B, further details are provided regarding various features of an exemplary embodiment of the present invention. In general, FIG. 5A illustrates an exemplary situation where an embodiment of the present invention is at a temperature substantially equal to room temperature (the room temperature configuration of nut 600 and component 400 are indicated generally by phantom lines in FIG. 5B). However, embodiments of the invention may be configured so that the exemplary configuration illustrated in FIG. 5A is indexed to, or corresponds to, other desired temperatures or conditions.

As suggested in FIG. 5B, when mounting system 200 is employed in a high heat environment, for example, a rotating anode type x-ray tube, the heat causes nut 600 to gradually, and elastically, deform. Consistent with a desired effect or application, various materials having different thermal characteristics may be employed in the construction of nut 600. For example, a nut 600 material that may be effective at relatively low temperatures may not be appropriate in high temperature environments that could cause plastic, or permanent, deformation of the nut.

Deformation of nut 600 may be imposed by a variety of physical mechanisms. For example, as support member 304 and/or component 400 expand in response to exposure to such heat, the axial forces, exerted in a direction generally parallel to axis "y," resulting from the linear thermal expansion of rotor stem 300, component 400, and/or other components with which mounting system 200 is employed, may cause deformation of nut 600. As another example, radial forces generated as a result of thermal expansion, and acting generally perpendicular to axis "x," typically include a component that acts upon nut 600 in such a way as to cause nut 600 to deform. As yet another example, deformation of nut 600 may occur upon overtightening of nut 600.

In the illustrated embodiment, the forces resulting from thermal expansion of one or more components of mounting system 200, or forces imposed by other mechanisms such as overtightening of nut 600, cause shaped surface 604 of nut 600 to move through a deformation angle θ. Generally, the deformation angle θ refers to the angular displacement of shaped surface 604 with respect to a reference position. In the present exemplary case, the reference position is the position of shaped surface 604 at room temperature. As nut 600 is cooled to the temperature corresponding to the reference position, nut 600 will re-assume its undeformed configuration and shaped surface 604 will return to the reference position.

Note that deformation angle θ is but one way in which to represent, or otherwise quantify, the extent of deformation of nut 600, and thus, the forces exerted thereon as a result of thermal expansion and contraction. Various other parameters and characteristics may likewise be employed to provide such information. By way of example, the width of slot 606 at the outer surface of nut 606 may be employed to indicate the extent to which nut 606 has deformed. Note further that the magnitude of deformation angle θ, or other suitable parameters, is generally proportional to the magnitude of the stress imposed upon mounting system 200.

As suggested in FIG. 5B, deformation of nut 600, manifested in the exemplary embodiment as the angular displacement of shaped surface 604, is facilitated by the presence of slot 606. Because the forces attributable to thermal expansion of mounting system 200 are at least partially exerted in deforming nut 600, rather than in compressing support member 304 or component 400, the compensating effect provided by such deformation correspondingly reduces the overall axial and/or radial stresses experienced in mounting system 200 as a result of high temperatures or other conditions.

Thus, nut 600 has the ability to deform in certain predefined conditions and thereby effectively redistribute at least some of the stress, axial and/or radial, imposed on mounting system 200. In particular, imposition of forces on mounting system 200 represents an overall input of energy to such mounting system. Absent the presence of nut 600, the input of such energy is manifested as compressive and/or shear stresses in one or more components of mounting system 200. The use of nut 600 however, permits at least some of the input energy to be exerted in elastically deforming nut 600 and, thus, a desirable reduction in the magnitude of such compressive and/or shear stresses is thereby realized. In this way, nut 600 is effective in redistributing at least some of the stress imposed on mounting system 200.

Note that in at least some embodiments of the invention, it may be desirable to radius some or all of the interior corners 606A of slot 606 so as to reduce or eliminate the likelihood of undesirable stress concentrations, and resulting stress cracks and fractures, at those locations. The same is likewise true with respect to thread roots 606B.

Note further that the illustrated configuration of nut 600 is exemplary only. In general, any configuration or geometry that provides the functionality of nut 600, as disclosed herein, may be employed. For example, some embodiments of nut 600 may employ multiple slots 606. Further, the various functions of nut 600 may be implemented by more than one component.

As an example of an embodiment wherein the functions of nut 600 are implemented by more than one component, shaped surface 604 of nut 600 may instead be located on support member 304, and mechanical interface 500 inverted so that shaped surface 502 bears on shaped surface 604, now disposed on support member 304 and oriented toward shaped surface 502. In this exemplary alternative embodiment, nut 600 would not require a shaped surface, but would still include one or more slots 606. The effect achieved with nut 600 of this alternative embodiment would nevertheless be the same as in the case of the illustrated embodiment. In particular, tightening of nut 600 would cause component 400, by way of shaped surface 502, to orient itself with respect to shaped surface 604 of support member 304.

Directing continuing attention now to the illustrated embodiment of nut 600, the construction of nut 600 gives it the ability to elastically deform in response to imposition of various stresses, including thermally induced stresses, on mounting system 200 thereby enables nut 600 to effectively reduce the levels of axial and/or other stresses present in mounting system 200. The ability of nut 600 to elastically deform in this way has other benefits as well. In particular, and as suggested by FIG. 5B, the ability of shaped surface 604 to slide with respect to shaped surface 502 means that shaped surface 604 is readily able to move as necessary to compensate for stresses imposed on mounting system 200 by thermal or other conditions.

That is, while the magnitude of radial force "R" (see FIG. 4) may change in response to heating and/or cooling of mounting system 200, radial force "R" nevertheless continues to be exerted uniformly about shaped surface 502 of mechanical interface 500, and is thereby effective in maintaining the centered position of component 400 over a range of operating temperatures. Further, because nut 600 is able to elastically deform in response to forces of varying magnitude, nut 600 is effective in imposing and maintaining a predetermined axial force on component 400, over a variety of operating conditions.

These features, and others, cooperate to maintain the centering of component 400 with respect to rotor stem 300 over a variety of operating conditions while also acting to alleviate or mitigate forces such as are experienced during high temperature operations, and thereby substantially reduce the likelihood of the plastic deformation of, or other damage to, the components of mounting system 200. Because the stability of the mechanical joint can be maintained over a wide range of operating conditions, embodiments of the present invention are effective in, among other things, foreclosing noise, vibration, and other undesirable consequences of unbalanced and/or unsecured mounted components.

The present invention may be embodied in other specific forms without departing from its spirit or essential characteristics. The described embodiments are to be considered in all respects only as illustrative and not restrictive. The scope of the invention is therefore described by the appended claims rather than by the foregoing description. All changes which come within the meaning and range of equivalency of the claims are to be embraced within their scope.

What is claimed is:

1. An x-ray device, comprising:

(a) an evacuated enclosure;

(b) an electron source disposed within said evacuated enclosure;

(c) a target anode positioned within said evacuated enclosure to receive electrons from said electron source, and said target anode defining an axial opening;

(d) a mechanical interface connected to said target anode and defining an axial opening substantially aligned with said axial opening defined by said target anode, and said mechanical interface defining a first substantially frustoconical surface;

(e) a rotor stem having a threaded portion and including a support member, said target anode being mounted to said rotor stem so that said target anode abuts said support member and at least a portion of said rotor stem resides within said axial opening of said target anode; and (f) a nut configured to engage said threaded portion of said rotor stem, said nut defining at least one substantially annular slot and including a second substantially frustoconical surface, wherein the second substantially frustoconical surface contacts at least a portion of said first substantially frustoconical surface of said mechanical interface when said target anode is retained against said support member by said nut.

2. The x-ray device as recited in claim 1, wherein said first substantially frustoconical surface defines a first angle relative to a longitudinal axis of the rotor stem and said second substantially frustoconical surface defines a second angle relative to the longitudinal axis of the rotor stem, a difference between the first angle and the second angle comprising an offset angle.

3. The x-ray device as recited in claim 2, wherein said offset angle is defined with respect to a reference temperature.

4. The x-ray device as recited in claim 1, wherein said mechanical interface is integral with said target anode.

5. The x-ray device as recited in claim 1, wherein the support member is disposed between first and second ends of the rotor stem.

6. The x-ray device as recited in claim 1, wherein an offset angle $\delta$ is defined by a difference between a nut angle $\alpha$ and a mechanical interface angle $\beta$.

7. The x-ray device as recited in claim 1, wherein the nut is configured and arranged to exert both radial and axial forces with respect to the target anode.

8. The x-ray device as recited in claim 1, wherein the nut has an associated deformation angle $\theta$ which corresponds with an angular displacement of the second substantially frustoconical surface of the nut.

9. The x-ray device as recited in claim 8, wherein the deformation angle $\theta$ is at least partially a function of a force exerted in connection with the nut.

10. The x-ray device as recited in claim 1, wherein uniformity of exertion of a radial force "R" associated with the nut is substantially unaffected by temperature changes.

* * * * *

UNITED STATES PATENT AND TRADEMARK OFFICE

CERTIFICATE OF CORRECTION

PATENT NO. : 7,184,520 B1
APPLICATION NO. : 10/353433
DATED : February 27, 2007
INVENTOR(S) : Sano It is certified that error appears in the above-identified patent and that said Letters Patent is hereby corrected as shown below:

Column 3
Line 16, change "run-out" to --runout--

Column 12
Line 5, change "606" to --600--
Line 6, change "606" to --600--

Signed and Sealed this

Twenty-third Day of November, 2010

David J. Kappos

David J. Kappos
*Director of the United States Patent and Trademark Office*